US010151041B2

(12) United States Patent
Han

(10) Patent No.: US 10,151,041 B2
(45) Date of Patent: Dec. 11, 2018

(54) MANUFACTURING METHOD OF METAL MASK AND MASK FOR DEPOSITION USING SAID METHOD

(71) Applicant: SAMSUNG DISPLAY CO., LTD., Yongin-si, Gyeonggi-Do (KR)

(72) Inventor: Jeong Won Han, Seongnam-si (KR)

(73) Assignee: Samsung Display Co., Ltd., Yongin-si, Gyeonggi-do (KR)

( * ) Notice: Subject to any disclaimer, the term of this patent is extended or adjusted under 35 U.S.C. 154(b) by 75 days.

(21) Appl. No.: 14/864,924

(22) Filed: Sep. 25, 2015

(65) Prior Publication Data

US 2016/0289854 A1 Oct. 6, 2016

(30) Foreign Application Priority Data

Mar. 31, 2015 (KR) ..... 10-2015-0045314

(51) Int. Cl.
*C25D 1/10* (2006.01)

(52) U.S. Cl.
CPC ..... *C25D 1/10* (2013.01)

(58) Field of Classification Search
CPC ... C25D 1/10; C25D 1/08; C25D 1/20; C25D 1/00
See application file for complete search history.

(56) References Cited

U.S. PATENT DOCUMENTS 4,565,616 A * 1/1986 Kenworthy ..... C25D 1/10 204/192.26
6,214,192 B1 * 4/2001 Hawkins ..... B41J 2/1433 205/118
7,572,338 B2 * 8/2009 Kim ..... C23C 14/042 118/504
2001/0028936 A1 * 10/2001 Nishiyama ..... B29C 45/2632 428/848.3

FOREIGN PATENT DOCUMENTS

KR 10-2005-0120170 A 12/2005
KR 10-2006-0032116 A 4/2006
KR 10-2007-0002553 A 1/2007
KR 10-1267220 B1 5/2013
KR 10-2014-0005464 A 1/2014
KR 10-2014-0118507 A 10/2014

OTHER PUBLICATIONS

R. B. Darling/EE-527 "Key Technologies of Wet Etching."
URL-1-http://www-me.ccny.cuny.edu/ccnf/Contents/Wet.html.
URL-2-http://greman.univ-tours.fr/axis-3/development-of-anisotropic-structures-by-electrochemical-etching-for-3d-devices-276485.kjsp.
URL-3-http://www.nilt.com/default.asp?Action=Details&Item=504.
URL-4-http://en.wikipedia.org/wiki/Nanoimprint_lithography.

* cited by examiner

*Primary Examiner* — Louis J Rufo
(74) *Attorney, Agent, or Firm* — Lee & Morse, P.C.

(57) ABSTRACT

A mask manufacturing method, including manufacturing a first mold, including forming first patterns having inclined (Continued)

surfaces by patterning a silicon substrate; manufacturing a second mold, including forming second patterns that correspond to the first patterns by coating and curing a hardener on a surface of the first mold in which the first patterns are formed; separating the second mold from the first mold; forming a mask pattern by coating a metal layer on the second mold; and separating the metal layer from the second mold.

15 Claims, 15 Drawing Sheets

MANUFACTURING METHOD OF METAL MASK AND MASK FOR DEPOSITION USING SAID METHOD

CROSS-REFERENCE TO RELATED APPLICATION

Korean Patent Application No. 10-2015-0045314, filed on Mar. 31, 2015, in the Korean Intellectual Property Office, and entitled: "Manufacturing Method of Metal Mask and Mask for Deposition Using Thereof," is incorporated by reference herein in its entirety.

BACKGROUND

1. Field

The described technology relates to a mask manufacturing method and a mask for deposition manufactured using the mask manufacturing method.

2. Description of the Related Art

Among display devices, an organic light emitting display device may have a wide viewing angle, excellent contrast, and a fast response time. In such an organic light emitting display device, several sub-pixels may form one pixel.

During a process for manufacturing an organic light emitting display device, each sub-pixel may be formed using various methods, for example, a deposition method.

SUMMARY

Embodiments may be realized by providing a mask manufacturing method, including manufacturing a first mold, including forming first patterns having inclined surfaces by patterning a silicon substrate; manufacturing a second mold, including forming second patterns that correspond to the first patterns by coating and curing a hardener on a surface of the first mold in which the first patterns are formed; separating the second mold from the first mold; forming a mask pattern by coating a metal layer on the second mold; and separating the metal layer from the second mold.

The first patterns may be concave patterns, and the second patterns may be protruding patterns.

A thickness of the metal layer may be smaller than a thickness of the second patterns.

The silicon substrate may be an anisotropic silicon substrate, and in manufacturing the first mold, anisotropic etching may be performed on the silicon substrate.

The silicon substrate may be formed of a (100)-oriented silicon substrate.

Each first pattern may have a triangular-shaped cross-section having one open side.

Each first pattern may have a trapezoid-shaped cross-section having one open side.

The hardener may include a thermosetting resin.

In manufacturing the second mold, a carrier substrate may be layered above the hardener.

The hardener may include a photosensitive resin.

In manufacturing the second mold, a light transmissive electric conductive layer and a carrier substrate may be sequentially layered above the hardener.

Two or more first patterns may be formed in the silicon substrate at a distance from each other, and two or more second patterns may be disposed at locations corresponding to the first patterns.

In separating the second mold, spaces between neighboring second patterns may be opened by performing an etching process on the hardener.

The metal layer may be formed through an electroforming coating process.

Embodiments may be realized by providing a mask for deposition, manufactured using the presently disclosed mask manufacturing method and having mask patterns formed therein. The mask pattern may be gradually narrowed toward a rear plane of the mask from a front plane of the mask.

A shape of the mask pattern viewed from the front plane may be a rectangular-shaped cross-section.

The shape of the mask pattern viewed from the front plane may be a rectangular shape.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
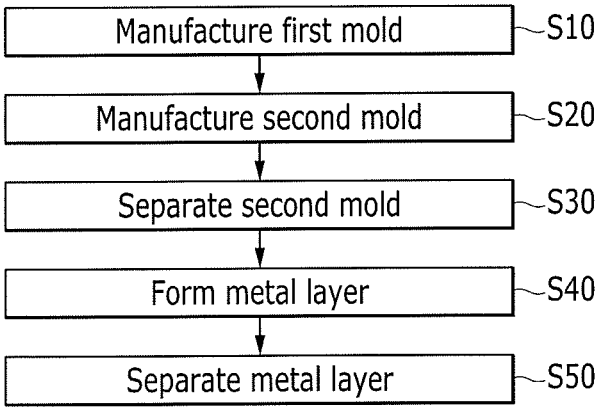
FIG. 1 illustrates a flowchart of a mask manufacturing method according to an exemplary embodiment.

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. Like reference numerals refer to like elements throughout.

In the described technology, the word "on" means positioning on or below the object portion, but does not essentially mean positioning on the upper side of the object portion based on a gravitational direction.

In addition, throughout this specification and the claims which follow, unless explicitly described to the contrary, the word "comprise/include" or variations such as "comprises/includes" or "comprising/including" will be understood to imply the inclusion of stated elements but not the exclusion of any other elements.

In the described technology, a mask may be a fine metal mask including two or more mask patterns in an organic material deposition process during a process for manufacturing an organic light emitting display device and forming a pixel in a display substrate by dropping an organic material through an opened portion in the mask pattern.

FIG. 1 illustrates a flowchart of a mask manufacturing method according to an exemplary embodiment.

Referring to FIG. 1, a mask manufacturing method according to the exemplary embodiment may include manufacturing a first mold in which a first pattern having an inclined surface may be formed by patterning a silicon substrate (S10), manufacturing a second mold in which a second pattern that corresponds to the first pattern may be formed by coating and curing a hardening agent in a surface of the first mold, in which the first pattern may be formed (S20), separating the second mold from the first mold (S30), forming a metal layer having a mask pattern in the second mold (S40), and separating a plated metal layer from the second mold (S40).

Hereinafter, each operation of the mask manufacturing method according to the exemplary embodiment will be described in detail with reference to FIG. 1 and FIG. 2 to FIG. 10.

Figure 2:
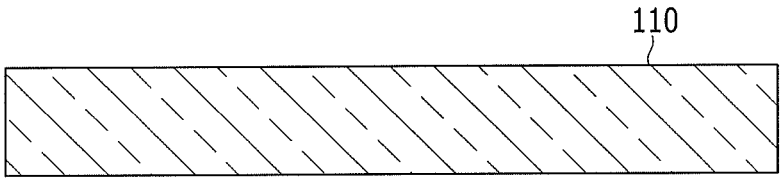
FIG. 2 to FIG. 9 sequentially illustrate a mask manufacturing process according to the exemplary embodiment.
Figure 3:
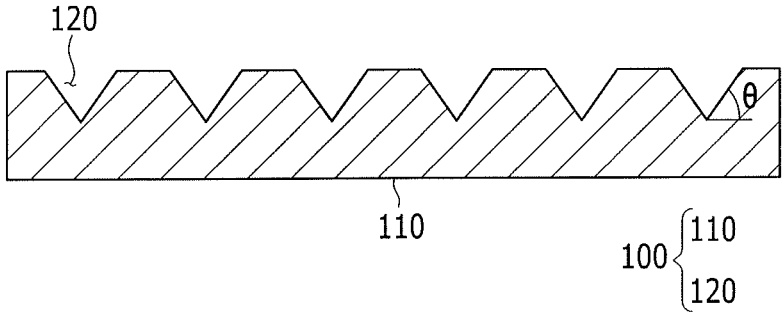

FIG. 2 illustrates alignment of a silicon substrate 110 in the mask manufacturing process according to the exemplary embodiment, and FIG. 3 illustrates the silicon substrate 110 patterned to have a concave inverted triangle-shaped pattern.

First, referring to FIG. 2 and FIG. 3, a flat silicon substrate 110 may be prepared in the operation for manufacturing the first mold (S10). The silicon substrate 110 may be manufactured by using anisotropic silicon. Physical characteristics of the silicon substrate 110 may vary according to a specific orientation.

In the present exemplary embodiment, the silicon substrate 110 may be manufactured using anisotropic silicon having orientation of (100) plane (denoted by the Miller index). In an embodiment, the silicon substrate 110 may be manufactured using anisotropic silicon having orientation of (111) plane.

In FIG. 3, an anisotropic etching process may be performed according to the orientation of the silicon to the surface of the silicon substrate 110 in order to manufacture a first mold 100 where, e.g., in which, a first pattern 120 is formed at the surface thereof. In the present exemplary embodiment, the surface of the silicon may be processed using an anisotropic etching method, which is one anisotropic silicon processing method. As shown in FIG. 3, in an embodiment, the first pattern 120 having concave inverted triangle shapes may be formed in the surface of the silicon substrate 110. In an embodiment, the shape of the first pattern 120 may vary.

Due to, for example, characteristics of the anisotropic silicon, an inclination angle θ of a cross-section of the processed first pattern 120 may have a constant angle. In the present exemplary embodiment, silicon having the orientation of (100) plane may be used, and the silicon substrate 110 may have a concave triangle pattern having a constant angle of 54.74°, but the angle may be changed according to the orientation of the silicon.

Two or more first patterns 120 may be formed at an equal distance from each other in the surface of the silicon substrate 110. The inclination angle θ of the first pattern 120 may be processed to have the same angle of 54.74° according to the (100)-oriented silicon, and the concave patterns between the respective first patterns 120 may have the same cross-section and stereoscopic shape.

As described, in the operation for manufacturing the first mold (S10), the silicon substrate 110 having an orientation of one direction may be processed using a method such as etching, two or more first patterns 120 may be formed, each may have precisely equal cross-sections and stereoscopic shapes by an anisotropic feature of the material, and the process precision of the silicon substrate 110 may be increased without using an additional precise processing device or processing process.

Figure 4:
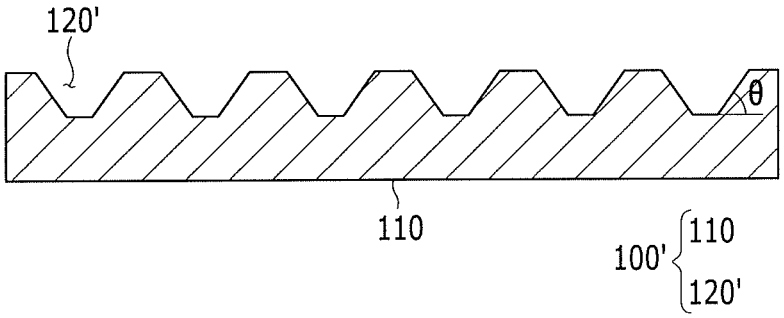

In FIG. 4, the silicon pattern 110 may be patterned to have a concave trapezoid-shaped pattern.

In the present exemplary embodiment, as compared to the concave inverted triangle-shaped pattern of the first pattern 120 of FIG. 3, a first pattern 120' may be concave in the shape of a trapezoid. An inclination angle θ of the first pattern 120' may also be processed with an angle of 54.74°, which may be the same as the first pattern 120 of the (100)-oriented silicon. The silicon substrate 110 may be processed using an anisotropic etching method in the exemplary embodiment, and the inclination angle, e.g., angles, θ of the first pattern may equally have, e.g., be, 54.74°, but the specific shape of the first patterns may be different from each other as shown in FIG. 3 and FIG. 4.

Figure 5:
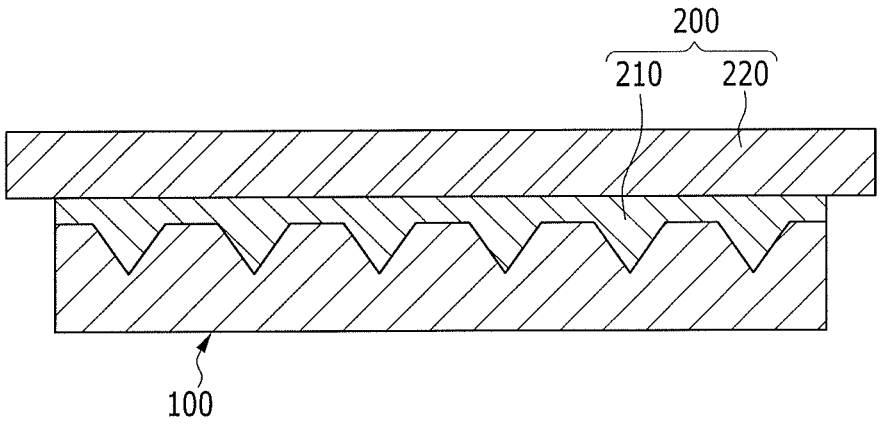

FIG. 5 illustrates a structure in which a hardener 210 and a carrier substrate 220 may be sequentially layered in the completed first mold 100 according to the exemplary embodiment.

Referring to FIG. 5, in the second mold manufacturing operation (S20), the hardener 210 may first be coated on the surface where, e.g., in which, the first pattern 120 is formed in the completed first mold 100. The coated hardener 210 may fill concave spaces of the first pattern 120 as shown in FIG. 5. For example, a thermosetting resin where, e.g., in which, cross-linking is formed between internal molecules by heat, and strongly hardens, may be used as the hardener 210 in the present exemplary embodiment.

After coating of the hardener 210, the carrier substrate 220 may be disposed on the hardener 210 and a heat source may be disposed on the carrier substrate 220, and then a process for curing the hardener 210 may be performed. Through such a process, a surface of the hardener 210, contacting the first mold 100, may have a protruding first pattern 120. For example, the hardener 210 may be cured to have protruding patterns corresponding to the first patterns 120 according to the first mold 100. The upper portion of the hardener 210 may be fixed by being bonded with the carrier substrate 220 through the curing process.

As described, in the second mold manufacturing operation (S20), the hardener 210 and the carrier substrate 220 may be sequentially layered on the first mold 100 and then cured, and a second mold having patterns that correspond to the first pattern 120 may be manufactured.

Figure 6:
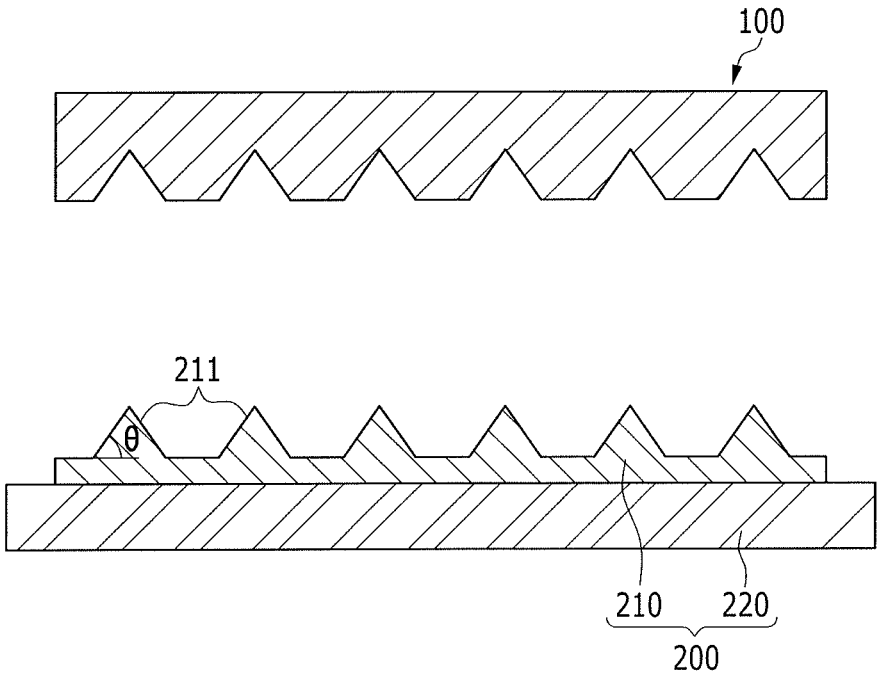
Figure 7:
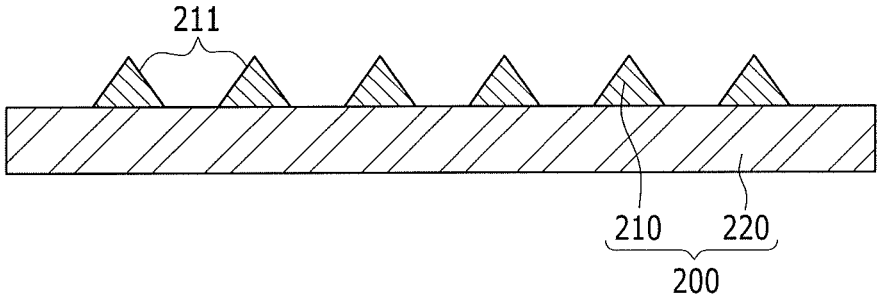

FIG. 6 illustrates a state in which the completed second mold 200 may be separated from the first mold 100 according to the exemplary embodiment, and FIG. 7 illustrates a state in which a gap between neighboring second patterns 211 of the second mold 200 may be opened.

First, referring to FIG. 6, in the second mold separation operation (S30), the completed second mold 200 may be separated from the first mold 100, and then the second mold 200 may be arranged to place patterns formed by the first mold 100 facing upward. In the present exemplary embodiment, the protruding pattern corresponding to the first pattern is defined as the second pattern 211.

The second pattern 211 may have a protruding shape corresponding to the concave shape of the first pattern 120, and an inclination angle of the protruding shape may also be equal to the inclination angle θ of the first pattern 120, which may be 54.74°.

Two or more second patterns 211 may protrude at locations corresponding to the first pattern 120, and neighboring second patterns 211 may be connected to each other as shown in FIG. 6.

Next, referring to FIG. 7, in the second mold separation operation (S30), the hardener 210 of the separated second mold 200 may be etched to open, e.g., form, gaps between neighboring second patterns 211, and a post-treatment process that may partially expose the upper surface of the carrier substrate 200 may be performed. Accordingly, spaces that may be separated from each other may be formed between the second patterns 211 as shown in FIG. 7.

A space between neighboring second patterns 211 may be etched using, for example, a dry-etching method.

Figure 8:
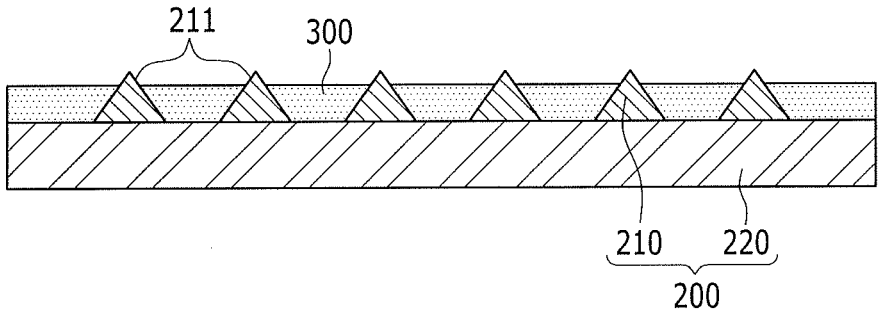

FIG. 8 illustrates a state in which a metal layer may be formed above the second mold 200 according to the exemplary embodiment.

Referring to FIG. 8, in the operation for forming the metal layer (S40), the metal layer 300 may be coated on the surface where, e.g., on which, the already manufactured second patterns 211 of the second mold 200 separate, e.g., are separated, and may be post-processed using the above-stated method. A predetermined mask pattern may be formed at a location corresponding to the second pattern 211 of the metal layer 30. As shown in FIG. 8, the maximum thickness of the metal layer 300 may be smaller than a vertical height of the second mold 200, and the mask pattern of the metal layer 300 may be opened when the metal layer 300 is separated from the second mold 200 through post-processing.

In the present exemplary embodiment, the metal layer 300 may be coated above the second mold 200 through an electro-forming coating process. In the present exemplary embodiment, the carrier substrate 220 may be formed of a conductive material for enabling the electro-forming coating process.

The electro-forming coating process in the present exemplary embodiment may have the benefit of having an accurate pattern forming error and position error in an output, and the problem caused by burring that may be occur in the surface of an output of a process using a relatively high precision laser may be solved.

Figure 9:
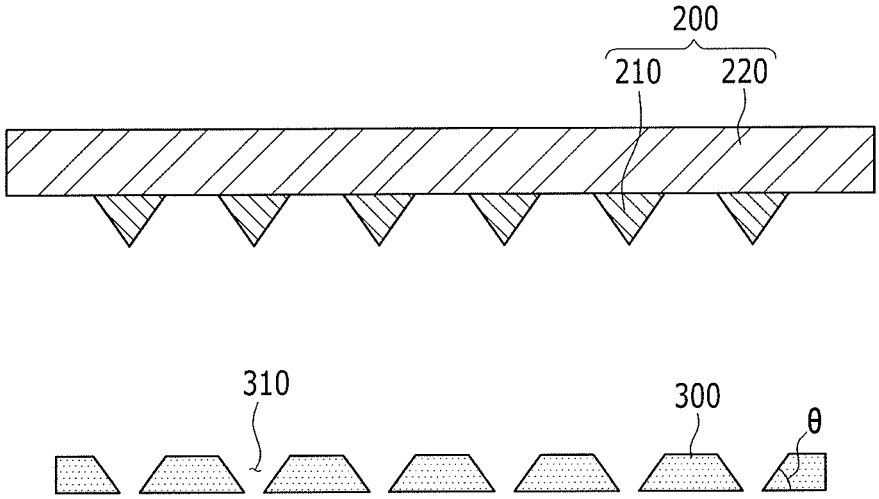
Figure 10:
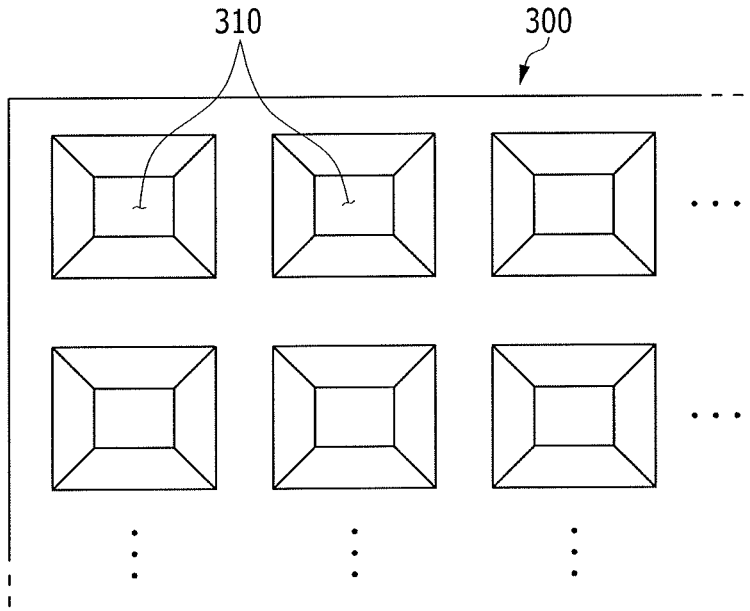
FIG. 10 partially illustrates a mask for deposition, measured according to the exemplary embodiment.

FIG. 9 illustrates a state in which the metal layer 300 and the second mold 200 may be separated according to the exemplary embodiment, and FIG. 10 illustrates a part of a deposition mask manufactured according to the exemplary embodiment.

First, referring to FIG. 9, in the metal layer separation operation (S50), when the metal forming operation (S40) is finished, the completed metal layer 300 may be separated from the second mold 200. Mask patterns 310 may be formed at locations respectively corresponding to the second patterns 210 in the surface of the separated metal layer 300. A lower inclination angle θ of the mask pattern 310 may be equal to the concave inclination angle θ of the first pattern 120 and the protrusion angle θ of the second pattern 211, which may be 54.74°.

As the surface of the separated metal layer 300 is planarized, the mask according to the exemplary embodiment may be manufactured as shown in FIG. 10.

Referring to FIG. 9 and FIG. 10, the mask patterns 310 of the completed mask may be arranged in a matrix format. The mask pattern 310 may be provided with an opening where an inclination is formed while gradually narrowing the width from top to the bottom, and edges of the mask pattern 310, formed by inclined surfaces, may be smoothly inclined rather than being rounded. Accordingly, the top and bottom openings of the mask pattern 310 may have rectangular-shaped, e.g., square-shaped, cross-sections.

In the case of existing masks, several etching processes may be performed to form mask patterns, errors may occur in the mask patterns due to, for example, the etching, and edges formed by inclined surfaces of the mask patterns may be rounded.

The mask according to the exemplary embodiment may be a mask for deposition, and when an upper surface of the mask is defined as a front plate, e.g., of the mask, and the opposite surface of the front plane is defined as a rear plane, e.g., of the mask, as shown in FIG. 10, the mask pattern 310 may be gradually narrowed from the front plane to the rear plane, but the shape of the mask viewed from the front plane may be rectangular, e.g., a square. For example, each mask pattern 310 may include four straight lines inclined downward from the front plane to the rear plane, and inclined lines, inclination surfaces, and neighboring downward inclined surfaces form a predetermined angle, and the shape of the mask viewed from the front plane may be rectangular, e.g., a square, as shown in FIG. 9.

However, as previously described, a mold provided with a specific inclination angle θ may be manufactured by applying an anisotropic silicon etching method and a mask manufacturing process may be continuously performed, and shapes of edges formed by inclined surfaces of the mask patterns 310 of the completed mask may be precisely controlled, and the mask may appropriately be used in a deposition process that may require deposition of a high-resolution organic material.

Hereinafter, each process of a mask manufacturing method according to an exemplary embodiment will be described in detail with reference to FIG. 1 and FIG. 11 to FIG. 15. In the following description of a mask manufacturing method according to an exemplary embodiment, processes that are the same as in the mask manufacturing method according to the above-stated exemplary embodiment will be omitted.

Figure 11:
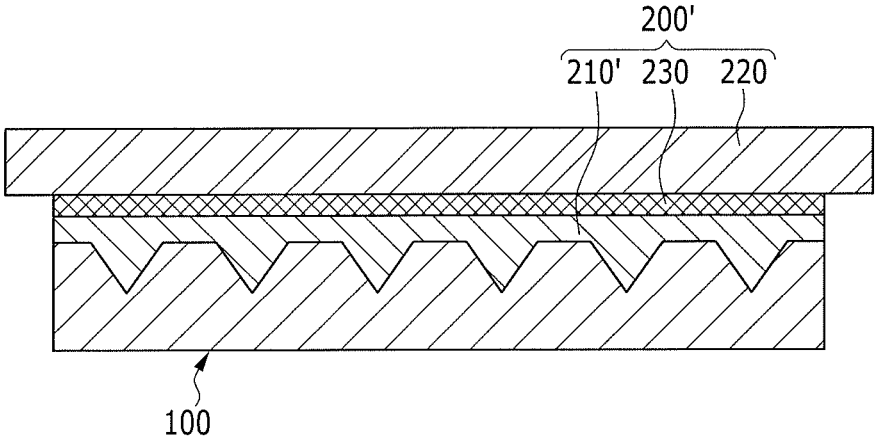
FIG. 11 to FIG. 15 sequentially illustrate a process for manufacturing a mask according to an exemplary embodiment.

FIG. 11 illustrates a structure in which a hardener 210' and a carrier substrate 220 may be sequentially layered on a completed first mold 100.

Referring to FIG. 11, a photo curable resin may be coated as a hardener 210' in the operation for manufacturing a second mold (S20). The coated hardener 210' may fill concaved spaces of first patterns 120 as shown in FIG. 11.

After coating the hardener 210', a light transmissive electric conductive layer 230 and the carrier substrate 220 may be sequentially disposed above the hardener 210'. For example, the light transmissive electric conductive layer 230 may be provided between the carrier substrate 220 and the hardener 210'. An adhesive layer may be formed between the light transmissive electric conductive layer 230 and the carrier substrate 220. The carrier substrate 220 may be made of a material such as light transmissive glass, such that light may reach the hardener 210'.

Next, a photo imprinting process may be performed by disposing a light source in the hardener 210'. Light emitted from the light source may sequentially pass through the carrier substrate 220 and the light transmissive electric conductive layer 230, and then may be irradiated on the hardener 210' and the hardener 210' may be cured through the photo imprinting process. In the present exemplary embodiment, ultraviolet light may be used as light irradiated on the hardener 210'.

Figure 12:
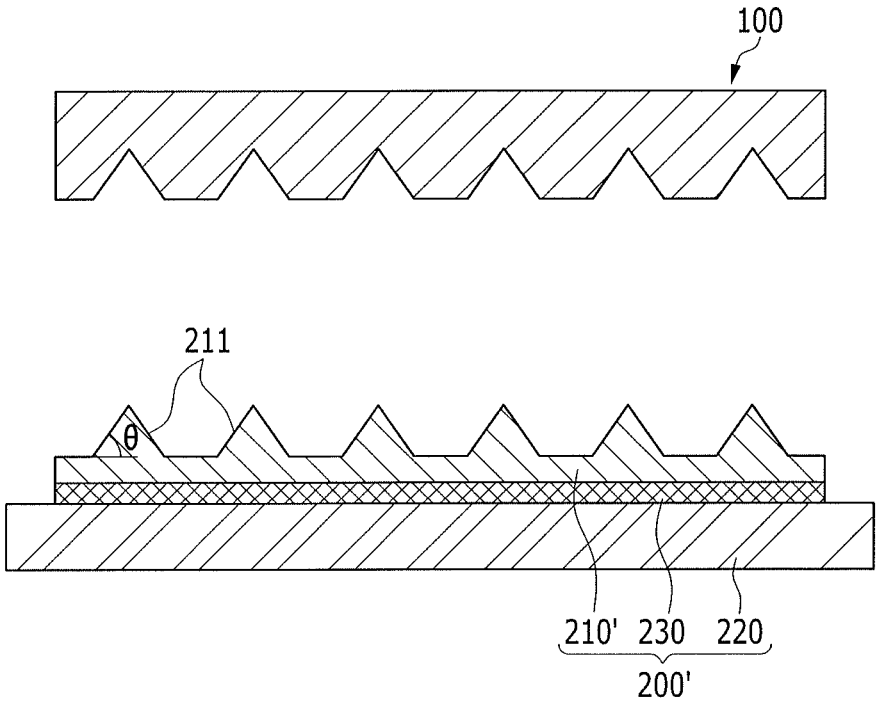
Figure 13:
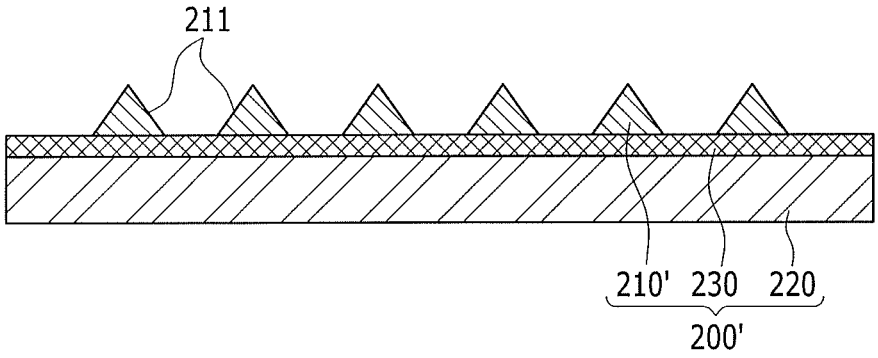

FIG. 12 illustrates a state in which a completed second mold 200' and the first mold 100 may be separated from each other according to the present exemplary embodiment, and FIG. 13 illustrates a state in which spaces between neighboring second patterns 211 of the second mold 200' according to the present exemplary embodiment may be opened.

First, referring to FIG. 12, the completed second mold 200' may be separated from the first mold 100 in the operation for separating the second mold (S30), and then the second mold 200' may be disposed to make the patterns formed by the first mold 100 face upward.

Like the second patterns of the above-stated exemplary embodiment, the second patterns 211 formed in the second mold 200' may have protruding shapes corresponding to concave shapes of the first patterns 210, and an inclination angle θ of the protruding shape may also be equal to an inclination angle θ of the first pattern 120, which may be, 54.74°.

Next, referring to FIG. 13, the hardener 210' of the separated second mold 200' may be etched in the second mold separating operation (S30) to open, e.g., form, spaces between neighboring second patterns 211, and a post-process may be performed to partially expose the upper surface of the light transmissive electric conductive layer 230. For example, the upper surface of the carrier substrate 200 may be partially exposed in the above-stated exemplary embodiment, but in the present exemplary embodiment, the upper surface of the light transmissive electric conductive layer 230 may be partially exposed.

Figure 14:
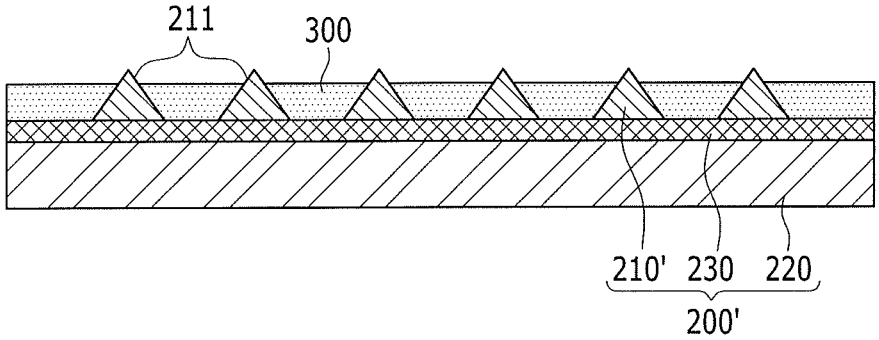

FIG. 14 illustrates a state in which a metal layer may be formed above the second mold 200' according to the present exemplary embodiment.

Referring to FIG. 14, in the operation for forming a metal layer (S40), the metal layer 300 may be coated on a surface where the second patterns 211 of the second mold 200' are manufactured, separated, and post-processed through the above-stated method.

Figure 15:
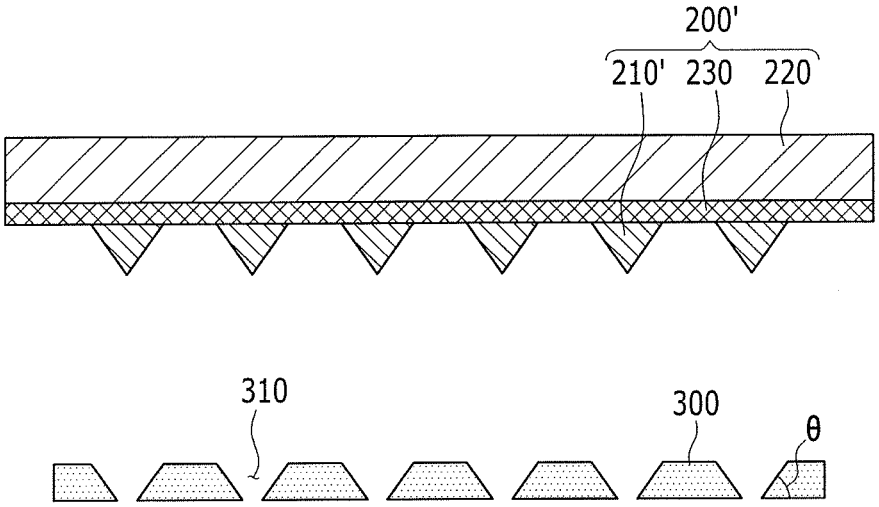

FIG. 15 illustrates a state in which the metal layer 300 and the second mold 200' may be separated according to the present exemplary embodiment.

Referring to FIG. 15, in the operation for separating the metal layer (S50), the completed metal layer 300 may be separated from the second mold 200' after the operation for forming the metal layer (S40) is finished.

Next, the surface of the separated metal layer 300 may be planarized, and as shown in FIG. 10, a mask that may be the same as the mask of the above-stated exemplary embodiment may be manufactured.

As described, according to the mask manufacturing method according to the present exemplary embodiment, although the photo imprinting process may be performed using a light source instead of using a heat source in the process for forming the first mold, a mask may be manufactured with edges formed by inclined surfaces of the mask patterns 310 that may be smoothly inclined rather than being rounded.

By way of summation and review, during a process for manufacturing an organic light emitting display device, each sub-pixel may be formed using various methods, for example, a deposition method.

In order to form a sub-pixel using a deposition method, a fine metal mask (FMM) having the same pattern as a pattern of a thin film to be formed on a substrate may be aligned. In the fine metal mask, through-holes may be formed in portions corresponding to the pattern. A thin film having a desired pattern may be formed by depositing an organic material on the substrate using the fine metal mask.

According to a method for manufacturing a comparative fine metal mask, upper and lower sides thereof may be respectively etched. In such a comparative fine metal mask, cross-sections of through-holes corresponding to a portion where an organic material may be deposited may have overlapping semicircles. The through-hole may partially protrude, and the shape of the through-hole when viewed from above may have rounded oval-shaped corners, rather than having shapes for precise deposition of the organic material, and deposition may fail. Display devices having high resolution may be developed, a more precise organic material deposition may be required, and forming the shape of the through-hole portion may need to be improved.

In order to overcome such deposition failure, the through-hole may be gradually widened using a laser in manufacturing a fine metal mask, but layer processing layers may need to be sequentially processed for more precise processing, which may cause a long processing time.

The described technology relates to a method for manufacturing a mask for deposition that may be used in a deposition process of, for example, a semiconductor or a display device, and a mask for deposition manufactured using the method.

Provided is a mask that may deposit a high-resolution organic material using anisotropic etching according to an orientation of silicon, and a manufacturing method thereof.

The mask manufacturing process according to the exemplary embodiment may be appropriate for use in a deposition process that may require deposition of a high-resolution organic material, because a mold provided with a specific inclination angle θ may be manufactured by applying an anisotropic silicon etching method and a mask manufacturing process may be continuously performed so that the shapes of edges formed by the inclined surfaces of the mask patterns 310 of the completed mask may be precisely controlled.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A mask manufacturing method, comprising:

manufacturing a first mold, including forming first patterns having inclined surfaces by patterning a silicon substrate;

manufacturing a second mold, including forming second patterns that correspond to the first patterns by coating and curing a hardener on a surface of the first mold in which the first patterns are formed;

separating the second mold from the first mold;

forming a mask pattern by coating a metal layer on the second mold; and separating the metal layer from the second mold to form a mask for forming at least a portion of a sub-pixel of a display device, wherein, in manufacturing the second mold, a light transmissive electrically conductive layer and a carrier substrate are sequentially layered above the hardener, in manufacturing the second mold, the hardener is hardened through a photo imprint process that is performed by disposing an ultraviolet light source in front of the carrier substrate and emitting ultraviolet light to pass through the carrier substrate and the light transmissive electrically conductive layer, wherein the light transmissive electrically conductive layer transmits ultraviolet light and is electrically conductive, and the carrier substrate is formed of a transparent material that transmits the ultraviolet light.

2. The mask manufacturing method as claimed in claim 1, wherein:

the first patterns are concave patterns, and the second patterns are protruding patterns.

3. The mask manufacturing method as claimed in claim 1, wherein a thickness of the metal layer is smaller than a thickness of the second patterns.

4. The mask manufacturing method as claimed in claim 1, wherein:

the silicon substrate is an anisotropic silicon substrate, and in manufacturing the first mold, anisotropic etching is performed on the silicon substrate.

5. The mask manufacturing method as claimed in claim 4, wherein the silicon substrate is formed of a (100)-oriented silicon substrate.

6. The mask manufacturing method as claimed in claim 1, wherein each first pattern has a triangular-shaped cross-section having one open side.

7. The mask manufacturing method as claimed in claim 1, wherein each first pattern has a trapezoid-shaped cross-section having one open side.

8. The mask manufacturing method as claimed in claim 1, wherein the hardener includes a thermosetting resin.

9. The mask manufacturing method as claimed in claim 1, wherein the hardener includes a photosensitive resin.

10. The mask manufacturing method as claimed in claim 1, wherein:

two or more first patterns are formed in the silicon substrate at a distance from each other, and two or more second patterns are disposed at locations corresponding to the first patterns.

11. The mask manufacturing method as claimed in claim 10, wherein, in separating the second mold, spaces between neighboring second patterns are opened by performing an etching process on the hardener.

12. The mask manufacturing method as claimed in claim 1, wherein the metal layer is formed through an electroforming coating process.

13. A mask for deposition, manufactured using a mask manufacturing method as claimed in claim 1 and having mask patterns formed therein, wherein the mask pattern is gradually narrowed toward a rear plane of the mask from a front plane of the mask.

14. The mask as claimed in claim 13, wherein a shape of the mask pattern viewed from the front plane is a rectangular-shaped cross-section.

15. The mask as claimed in claim 13, wherein the shape of the mask pattern viewed from the front plane is a rectangular shape.

* * * * *